US012559269B2

(12) United States Patent
Centorame et al.

(10) Patent No.: US 12,559,269 B2
(45) Date of Patent: Feb. 24, 2026

(54) DOSING APPARATUS, A MACHINE FOR PRODUCING SINGLE-DOSE CAPSULES AND RELATIVE DOSING METHOD

(71) Applicant: Fameccanica.Data S.p.A., San Giovanni Teatino (IT)

(72) Inventors: Oscar Centorame, San Giovanni Teatino (IT); Diego Gualtieri, San Giovanni Teatino (IT)

(73) Assignee: Fameccanica.Data S.p.A., San Giovanni Teatino Chieti (IT)

( * ) Notice: Subject to any disclaimer, the term of this patent is extended or adjusted under 35 U.S.C. 154(b) by 0 days.

(21) Appl. No.: 18/539,750

(22) Filed: Dec. 14, 2023

(65) Prior Publication Data

US 2024/0199252 A1 Jun. 20, 2024

(30) Foreign Application Priority Data

Dec. 15, 2022 (IT) ..... 102022000025749

(51) Int. Cl.
*B65B 9/04* (2006.01)
*B65B 1/30* (2006.01)
*B65B 29/02* (2006.01)

(52) U.S. Cl.
CPC ..... *B65B 9/042* (2013.01); *B65B 1/30* (2013.01); *B65B 9/045* (2013.01); *B65B 29/022* (2017.08)

(58) Field of Classification Search
CPC ..... B65B 9/042; B65B 9/045; B65B 29/022; B65B 1/30
USPC ..... 53/452
See application file for complete search history.

(56) References Cited

U.S. PATENT DOCUMENTS 3,851,441 A * 12/1974 Marchand ..... B65B 9/042 53/239
4,257,530 A * 3/1981 Faller ..... B65B 9/04 229/905
4,437,294 A * 3/1984 Romagnoli ..... B65B 1/366 53/553
2003/0014945 A1* 1/2003 Danby ..... B65B 37/20 53/558
2015/0336691 A1* 11/2015 Fowler ..... B65D 65/46 53/553
2015/0336692 A1* 11/2015 Brandt Sanz ..... C11D 17/042 53/450
2016/0068285 A1* 3/2016 Fowler ..... B65D 65/46 53/558
2016/0114914 A1* 4/2016 Kepinski ..... B65B 41/12 53/436
2016/0340068 A1* 11/2016 Brandt Sanz ..... C11D 17/042
2017/0088298 A1* 3/2017 McLenithan ..... B65B 61/06
(Continued)

OTHER PUBLICATIONS

Search Report dated Jul. 28, 2023. 6 pages.

*Primary Examiner* — Dariush Seif
(74) *Attorney, Agent, or Firm* — RMCK Law Group PLC

(57) ABSTRACT

A dosing apparatus for dosing powdered substances for producing single-dose capsules, having at least one compartment in which at least one powdered substance is present, including a forming unit having one or more molds movable in an advancement direction, and a dosing unit including at least one dosing plate having one or more chambers, in each of which a quantity of at least one of the powdered substances can be inserted, to be subsequently transferred from at least one of the chambers to a respective mold.

12 Claims, 6 Drawing Sheets

(56) References Cited

U.S. PATENT DOCUMENTS

| | | | | |
|---|---|---|---|---|
| 2017/0144785 | A1* | 5/2017 | Bartoli | B65B 29/02 |
| 2017/0368580 | A1* | 12/2017 | Brandt Sanz | B65B 47/02 |
| 2018/0290774 | A1* | 10/2018 | Fowler | B65B 9/042 |
| 2018/0362193 | A1* | 12/2018 | Howell, II | C11D 17/042 |
| 2020/0165019 | A1* | 5/2020 | Binacchi | B29C 66/849 |
| 2023/0174256 | A1* | 6/2023 | Brandt Sanz | B65B 9/023 53/434 |
| 2024/0043200 | A1* | 2/2024 | Risser | B65B 35/50 |
| 2024/0158113 | A1* | 5/2024 | Brandt Sanz | B65B 61/02 |
| 2024/0199252 | A1* | 6/2024 | Centorame | B65B 1/30 |

* cited by examiner

DOSING APPARATUS, A MACHINE FOR PRODUCING SINGLE-DOSE CAPSULES AND RELATIVE DOSING METHOD

CROSS-REFERENCE TO RELATED APPLICATION

This application claims priority to Italian Patent Application No. 102022000025749 filed Dec. 15, 2022. The disclosure of the above application is incorporated herein by reference in its entirety.

FIELD OF THE INVENTION

The present invention relates to a dosing apparatus, in particular for powdered products, and a relative dosing method.

The present invention also relates to a machine for producing capsules with one or more compartments.

In greater detail, the invention concerns an apparatus of the aforesaid type, designed and created in particular to allow the dosing of powdered products and the hermetic closure for producing capsules with one or more compartments, which can be used for any case in which it is necessary to carry out an optimal closure or welding of said compartments.

The following description is directed in particular to the production of single-dose capsules in the field of detergents for household appliances such as washing machines, dishwashers, and the like, but it is apparent that the description should not be considered limited to this specific use.

DESCRIPTION OF THE PRIOR ART

As is well known, there are currently systems for the serial or continuous production of single-dose capsules (or "caps") for powders, gels and liquids, such as detergents, cosmetics, and the like.

These single-dose capsules are designed to contain one or more types of liquids, gels and/or powders. In particular, referring, by way of example, to the detergent sector, these single-dose capsules also include two or more compartments, to contain combinations of substances in powder form, liquids or gels, which allow—during use—obtaining the required washing performance, as well as having a valuable aesthetic appearance. In fact, generally these compartments may take on various shapes and colors, so as to satisfy different marketing needs.

Such single-dose capsules are generally of two types, i.e., side-by-side, wherein the compartments of the single-dose capsule are placed side-by-side, and superimposed, in which the compartments of the capsule are superimposed. In both cases, specific mechanical solutions are required to create the capsules, with specific synchronizations of parts and units, obtained through ad hoc programming systems.

The industrial processes used to produce single-dose side-by-side capsules generally involve the deformation of a polyvinyl acetate (PVA) film, which is preheated and then placed on a work surface. The PVA film is then deformed onto cavities or molds having the shape of the compartments to be filled with the products required to obtain the required capsule.

The powders that the compartments of the single-dose capsules must contain are dosed into the molds, already covered with PVA film. This dosing occurs before the cavities are closed and sealed with an additional PVA film.

Subsequently, a second PVA film closes and seals the previously filled cavities, creating the finished product called "side-by-side".

For producing superimposed single-dose capsules, industrial methods or processes are also known in the field, which provide, unlike the method described above for the side-by-side case, the use of a third PVA film to create the compartment superimposed on the one previous created.

The solutions known in the field, however, have production limitations. In particular, in systems or plants according to the prior art, a first PVA film is continuously arranged on the pre-formed cavities or molds, along an advancement direction, and pre-heated so as to be deformable.

The PVA film is then deformed to cover the mold, using a vacuum system. The filling of the powder in the coated cavities then occurs by gravity, by a dosing system typically with a fixed nozzle. This dosing operation must be synchronized with the movement of the cavities and, therefore, completed in a time interval less than the time that the cavity takes to transit at the dosing nozzle.

A technical problem of this solution is that the filling operation is not always able to guarantee a uniform stratification of the powder in the mold.

A further technical problem of the described solution is that dispersions of the powder may contaminate the outer edges of the pocket were welding of the second PVA film, arranged above, is carried out. This, in turn, may cause problems with the sealing of the capsule compartments, which have to be avoided when one of the compartments, e.g., a compartment adjacent to one that has been filled with dispersed powder, has to be filled with a liquid product.

This dispersion of powder in the gravity dosing step is greater in the case of low granularity powders. In this case, in fact, there is a greater probability that powder granules may partially disperse in the area surrounding the mold.

Furthermore, the feed rate of the cavities coated with the first PVA film is restricted (and limited) to the time interval needed to fill the cavities (i.e. the compartment which will then actually be created once a second PVA film has been welded to close the capsule compartment). In general terms, the greater the volume of powder to be deposited in the cavity, the longer the filling time, and consequently the longer the nozzle has to dose the product at the mold.

Among other things, the geometry of the pre-coated cavity influences the quality of the powder distribution, resulting in non-uniform stratification. Currently, market demands are increasingly converging towards capsule compartments with non-uniform sections both longitudinally (advancement direction of the cavities) and transversally, thus further worsening the distribution of the product in the compartment.

It seems clear that this procedure is onerous in terms of product quality and physical limitations of the production capacity of the currently available systems.

Dosing systems such as the one described in international patent application WO 2020/121271 A1 are known in the field, having a plurality of devices for inserting a liquid product into a respective compartment, which present a generally independent but coordinated movement during the compartment filling step. However, the solution described in this international patent application does not allow controlled filling such as to avoid the leakage problems indicated above. Furthermore, the systems described are not suitable for filling compartments with powder products.

OBJECT AND SUMMARY OF THE INVENTION

The object of the present invention is to provide a dosing apparatus that overcomes the problems of the prior art.

According to the present invention, this object is achieved by a dosing apparatus having the features of claim 1.

According to another aspect, the invention relates to a method for dosing powders having the features of claim 6.

According to a further aspect, the invention relates to a machine for producing capsules with one or more compartments having the features of claim 4.

The claims form an integral part of the technical disclosure provided in relation to the invention.

These and other results are obtained according to the invention with an apparatus, a dosing method and a machine wherein at least one product dosing plate is provided in which the product to be dosed is pre-dosed. The plate then moves in synchronization with the pre-formed cavities for as long as it takes to complete the dosing operations.

The specific object of the present invention is therefore a dosing apparatus for dosing powdered substances for producing single-dose capsules for household appliances, such as washing machines, dishwashers and the like, having at least one compartment into which at least one of said products can be inserted. The dosing apparatus comprises a forming unit, having one or more molds movable in an advancement direction, and a dosing unit comprising, in turn, at least one dosing plate, having one or more chambers, in each of which can be inserted a predefinable quantity of product, to be subsequently transferred from at least one of said chambers to a respective mold.

Furthermore, according to the invention, said dosing plate may be arranged so as to close said one or more molds, while said pre-dosed quantity of product is transferred from at least one of said chambers to a respective mold.

Again according to the invention, the dosing plate and the molds do not present a relative motion while said pre-dosed quantity of product is transferred from at least one of said chambers to the respective mold.

Advantageously according to the invention, said at least one dosing plate may comprise at least one release valve, to enable the dispensing of said quantity of pre-dosed product into said one or more chambers. Furthermore, said dosing unit may comprise an assembly of pre-dosing hoppers, for inserting the respective quantity of pre-dosed product into said one or more chambers.

Furthermore according to the invention, said at least one dosing plate may present at least one dispensing duct for dispensing said quantity of pre-dosed product from said one or more chambers, and said release valve may be interposed between one of said one or more chambers and said at least one delivery duct.

Advantageously according to the invention, the assembly of pre-dosing hoppers may comprise a plurality of hoppers arranged according to one or more parallel rows.

Preferably according to the invention, said at least one dosing plate may be configured to perform a path comprising: a pre-dosing section, wherein said assembly of pre-dosing hoppers inserts said pre-dosed quantity of product into said chambers; and a dosing section, wherein each dosing plate is arranged next to, or in contact with, said one or more molds, so as to close it, and transfers the quantity of pre-dosed product from at least one of said chambers to a respective mold.

Again, according to the invention, following the pre-dosing section there is a positioning section, wherein said dosing plate may be moved so as to arrange itself on said one or more molds, and following said dosing section, there is a return section, wherein each dosing plate can move away from said molds to return to the pre-dosing section.

Still according to the invention, the dosing unit may comprise a first circular carousel, capable of removably coupling with said dosing plates to move them from said assembly of pre-dosing hoppers towards said one or more molds. The dosing unit may also comprise a second circular carousel, arranged downstream of said first circular carousel, capable of removably coupling with said dosing plates to move them from one or more molds towards the assembly of pre-dosing hoppers. The dosing unit may also comprise an upper connection guide, arranged between the first and the second carousel, and a lower connection guide arranged between the first and the second carousel. Each of the dosing plates may follow a closed path between said upper connecting guide, said first carousel, said second connecting guide and said second carousel.

Advantageously according to the invention, each of said dosing plates may present a containment cavity, and said release valve may be placed between the respective chamber and a respective containment cavity. Each of said dosing plates may be overturned when it is moved by said first or second carousel, and each of said chambers may be arranged at a respective mold for the transfer of said predefinable quantity of product from the containment cavity to a respective mold, by opening said release valve.

Again according to the invention, said dosing unit may comprise a first movement unit, and a second movement unit arranged after said first movement unit with respect to said advancement direction. Each of said first or second movement units may comprise a shaft, driven by a motor, a pair of arms, arranged opposite to said shaft and clamped to said shaft, so as to rotate around it, wherein each of said arms has a free fixed end, and two gripping members, each arranged at a respective end of one of said arms, configured for picking up and releasing a dosing plate. The first movement unit may be configured to pick up said dosing plate by said gripping members when said gripping members are located at said dosing unit, and release said dosing plate when said gripping members are located at said forming unit. The second movement unit may be configured to pick up said dosing plate by said gripping members when said gripping members are located at said forming unit, and release said dosing plate when said gripping members are located at said dosing unit.

Also according to the invention, the apparatus may comprise a first applicator assembly having a heated roller, arranged at said forming unit, to heat a first PVA film before being placed on said molds.

Still according to the invention, said apparatus may comprise a second applicator assembly, arranged downstream of the dosing unit, for applying a second PVA film. The second applicator assembly may comprise a wetting roller, to wet said second PVA film, and a pressure roller, arranged at said forming unit downstream of said dosing unit, to close said molds filled by the dosing plates, by said second PVA film.

Again according to the invention, in the second applicator assembly at each mold a duct connected to a vacuum system may be provided.

Still according to the invention, said forming unit may comprise a plurality of forming plates, moved along an advancement direction, wherein each forming plate includes a base, having a lower surface and an upper surface, and wherein one or more of said molds may be provided on said upper surface. The dosing plate may be arranged so as to approach said upper surface by placing a respective chamber at each mold, while the pre-dosed quantity of product is transferred from at least one of the chambers to a respective mold.

Advantageously according to the invention, each of the dosing plates may present a plurality of chambers, preferably arranged in a matrix, and each forming plate may present a plurality of molds having a shape and surface arrangement corresponding to that of the chambers of said dosing plates.

Preferably according to the invention, the forming unit may comprise a conveyor belt, wherein the lower surface of the base of the forming plates can be removably coupled to the conveyor belt. Furthermore, the conveyor belt may be of the closed loop type.

Furthermore, according to the invention, the forming unit may comprise a pair of continuous and parallel tracks to which the forming plates are bound.

Still according to the invention, the forming unit may comprise a continuous forming belt, wherein the molds are formed on the upper outer surface of the forming belt, and a pair of driving rollers for moving the forming belt in the advancement direction.

According to another aspect, the invention concerns a machine for producing single-dose capsules having at least one compartment in which at least one powdered substance is present, comprising at least one dosing apparatus as previously described.

The machine for producing single-dose capsules may comprise at least one liquid and/or gel dosing apparatus for dosing a quantity of liquid and/or gel into at least one other compartment of the single-dose capsules.

A further object of the present invention is a dosing method, for dosing powdered products, for producing single-dose capsules having at least one compartment into which at least one of said products can be inserted by a dosing apparatus as described above. The dosing method comprises the following steps: inserting a pre-dosed quantity of product into one or more chambers of at least one dosing plate; placing each dosing plate close to said forming unit, so that at least one chamber is arranged at a respective mold, so as to close it; and transferring said pre-dosed quantity of product into each chamber, into the respective mold.

Again according to the invention, in the transferring step, the dosing plate and the molds do not present a relative motion while said pre-dosed quantity of product is transferred from at least one of said chambers to a respective mold.

Still according to the invention, in said transferring step, the release valve relative to each chamber is opened to allow the passage of the pre-dosed quantity of product into the respective mold.

Advantageously according to the invention, the dosing method may comprise, before the approaching step, the step of coating said one or more molds with a first PVA film, and may comprise, following the transferring step, the step of closing the molds using a second PVA film.

BRIEF DESCRIPTION OF THE DRAWINGS

The invention will now be described in detail with reference to the attached drawings, given purely by way of non-limiting example, wherein.

It will be appreciated that the various figures may not be represented on the same scale. It will also be appreciated that some elements or components may not be illustrated to make other elements/components more visible and to simplify the understanding of the figures.

DETAILED DESCRIPTION

To produce capsules for detersives or detergents, for example, having one or more compartments with different products, machines are used that generally have mobile cavities or molds to be filled. These molds are previously coated with a plastic film, before being filled with the product to be packaged. In this solution, a system based on dosing plates is proposed, said plates are pre-filled with the contents to be transferred into the molds. These dosing plates are then arranged on the molds to be filled and are set to move at the same speed as the molds, so as not to present relative motion between them for the entire time needed to fill the mold. In this way, it is possible to increase the production of capsules by increasing the speed of movement of the molds and dosing plates, regardless of the quantity of product to be transferred.

Furthermore, the dosing plates, in the dosing step, move close to the mold to be filled, closing it, possibly hermetically, to prevent part of the product from accidentally leaking out or dispersing during filling.

In the various figures similar parts will be indicated with the same numerical references.

Figure 1:
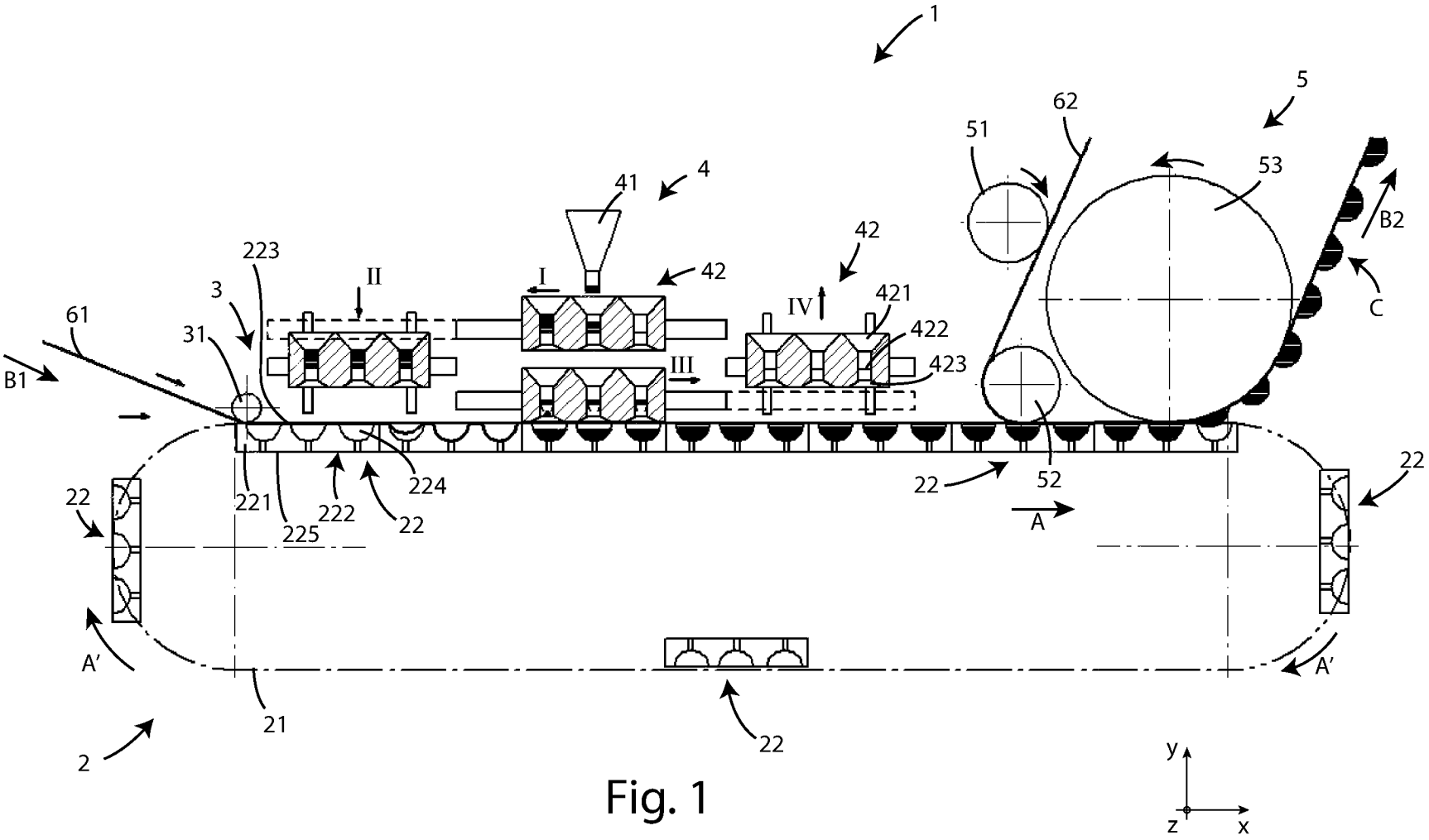
FIG. 1 shows a schematic side view of a first embodiment of a dosing apparatus according to the present invention.
Figure 2:
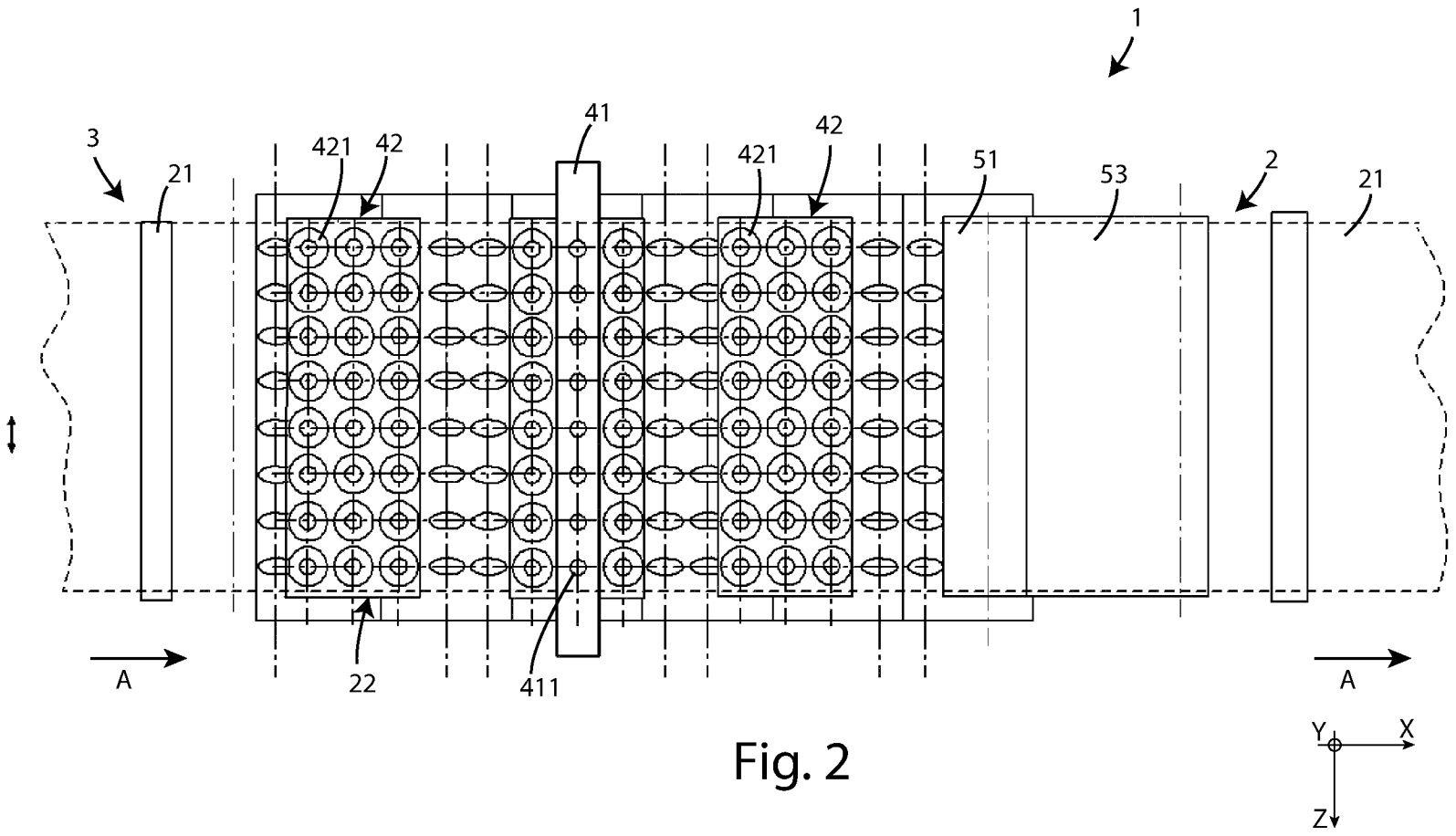
FIG. 2 shows a top view of the apparatus of FIG. 1.

Referring to FIGS. 1 and 2, a first embodiment of a dosing apparatus 1 according to the present invention is shown.

The dosing apparatus 1 comprises a forming unit 2, a first applicator assembly 3 for applying a first PVA tape or film, a dosing unit 4 and a second applicator assembly 5 for applying a second tape or PVA film.

The forming unit 2 comprises moving members and, in particular, a conveyor belt 21, with a closed cycle in the case in question, which rotates at a constant speed, and a plurality of forming plates 22, arranged on said conveyor belt 21 and always moved by the conveyor belt at a constant speed along an advancement direction indicated by arrow A.

The forming plates 22 may be arranged on the conveyor belt 21 adjacent to each other, or spaced apart, without following a specific order. Each forming plate 22, as can also be seen in particular in FIG. 2, has a base 221, having a lower surface 222 coupled or constrained to the conveyor belt 21, and an upper surface 223.

One or more molds 224 are made on the upper surface 223, having the shape of the compartments of the capsules to be made. Between one mold 224 and adjacent ones there is a portion of upper surface 223. In the embodiment being described, each forming plate 22 is a rectangular matrix having 24 identical molds 224 arranged in three rows of eight. However, in other embodiments the molds 224 may also have different shapes from each other depending on the product to be made.

Furthermore, for example in the case of producing single-dose capsules of the side-by-side type, two or more molds 224, even of different shapes, may be provided on the forming plate 22, grouped together to form the capsule.

Each mold 224 also has a duct 225, which puts it in communication with the lower surface 222 of the forming plate 22. Said duct 225 is connected to a vacuum system (not shown in the figures), the function of which will be better defined below.

In a preferred embodiment, the forming plates 22 are moved by the conveyor belt 21 by handling devices such as a plurality of linear motors (not shown in the figures), each of which moves a forming plate 22. Similarly, the dosing plates 42 may also be moved in some embodiments by respective linear motors.

The first applicator assembly 3 comprises a heated roller 31, arranged at the conveyor belt 21, so that the forming plates 22 pass under it while they are transported and fed by the conveyor belt 21. The heated roller 31 has the function of heating a first PVA film 61 for forming single-dose capsules to a temperature such as to make it deformable both plastically and elastically, so that after a mechanical deformation, which occurs through vacuum, as better explained below, the mold coating maintains its consistency and does not remain loose.

The first PVA film 61 is fed by a reel (not shown in the figure) in the direction indicated by the arrow B1, which is concordant and synchronized with the advancement direction A of the conveyor belt 21.

Therefore, the first PVA film 61 is fed and moves at the same speed as the forming plates 22 on top of which it is placed, covering the upper surface 223 and therefore the molds 224.

The dosing unit 4 essentially comprises an assembly of pre-dosing hoppers 41, which in the embodiment under consideration is made up of a series (array) of hoppers 411, and one or more dosing plates 42.

The assembly of pre-dosing hoppers 41 may use different product dosing systems, e.g., gravimetric, volumetric and the like, depending on the product to be dosed, which, as said, may be powder, liquid or gel. The dosing takes place using appropriate mechanical means, such as a screw pump, a scoop (not shown in the figures) and the like. Furthermore, the assembly of pre-dosing hoppers 41 may envisage one or more series of hoppers 411 arranged parallel to each other, so as to carry out the pre-dosing of several rows of chambers 421 of the dosing plates 42 at the same time.

In the embodiment shown, the dosing unit 4 of the dosing apparatus 1 comprises four dosing plates 42, but the number may vary according to production needs.

Each dosing plate 42 comprises a plurality of chambers 421 at the top, having a volume sufficient to accommodate the quantity of product to be inserted into each compartment of the single-dose capsule to be made. A release valve 422, of the electromechanically operated type, is provided at each chamber 421. The release valve 422 puts the chamber 421 into fluid dynamic communication with a delivery duct 423.

It should be considered that the release valves 422 may be of different types, mechanical, pneumatic, magnetic or electromagnetic.

The operation of the chambers 421, the release valves 422 and the delivery ducts 423 will be better described below. The dosing unit 4 is configured to allow each dosing plate 42 to follow a path that includes:

a pre-dosing section or step I, wherein each dosing plate 42 is located at the assembly of pre-dosing hoppers 41, for the insertion into each chamber 421 of the quantity of product to be subsequently inserted into a mold 224; in some embodiments, the chamber 421, once pre-filled with the product to be dosed, can be closed with a suitable closing member (not shown in the figures);

a positioning section or step II, wherein the dosing plate 42 is moved orthogonally downwards with respect to the feeding direction A of the forming plates 22 as moved by the conveyor belt 21; in this step, the speed of the dosing plate 42 is such as to prevent the powdered product contained from dispersing; furthermore, to allow the alignment of each dosing plate 42 with a respective forming plate 22, said dosing plate 42 may also assume an accelerated motion to obtain optimal alignment;

a dosing section or step III, wherein the dosing plate 42 is in contact (or almost in contact, or very close) with a respective forming plate 22, with respect to which it has zero relative movement; in this dosing section the dosing plate 42 doses the product previously loaded into each chamber 421 into a respective mold 224 of the forming plate 22 on which it is arranged; it should be considered that the approach of the dosing plate 42 to the respective forming plate 22 occurs through a programmed approach movement (or rather, towards the transport belt 21, so as to seal the perimeter of the mold 224); and finally, a return section or step IV, wherein each dosing plate 42 separates from the forming plate 22 of which it has filled the molds 224, to return to the pre-dosing section I.

In the various sections, the dosing plates 42 are always arranged horizontally (or rather, parallel to the X-Z plane of the Cartesian plane shown in the figures), so as not to overturn the product possibly contained in the chambers 421.

The movement of the dosing plates 42 may be carried out by electromechanical systems of different types, not shown in the present embodiment.

Among other things, in the pre-dosing step I each chamber 421 may be filled while the dosing plate 42 is moving, or rather stopping temporarily, with a step-by-step movement, according to the falling speed of the product (e.g., powder) and the diameter of the hoppers 411.

In addition, in the embodiment shown, the dosing plates 42 each move on an imaginary plane perpendicular to the conveyor belt 21 (i.e., referring to FIG. 1, on the plane of the sheet, or rather on the X-Y plane of the Cartesian plane shown in the figures). In other embodiments, however, in the sections II and IV, the dosing plates 42 could be moved on a plane parallel to the conveyor belt 21, or rather on the X-Z plane of the indicated Cartesian plane. In this case the dosing apparatus would be bulkier, but this configuration could have advantages in particular environments.

The second applicator assembly 5 comprises a wetting roller 51, which wets a second PVA film 62, a pressure roller 52, arranged at the conveyor belt 21 downstream of the dosing unit 4, which has the function of closing the capsules and, therefore, the relative compartments filled by the forming plates 22, by said second PVA film 62.

The second applicator assembly 5 also comprises an extraction roller 53, which extracts the series of capsules C finally made, with the respective compartments closed with the two PVA films, 61 and 62, respectively, separating them from the conveyor belt 21 for any subsequent cutting and packaging steps.

The operation of the dosing apparatus 1 described above takes place as follows.

When a forming plate 22 moved by the conveyor belt 21 is at the heated roller 31, the latter places the first heated PVA film 61 on its upper surface 223, covering all the molds 224. The first PVA film 61 is at a temperature sufficient to allow its mechanical deformation.

The vacuum system, which acts through the ducts 225, deforms the first PVA film 61, so that it adheres to the concave walls of each mold 224, covering it.

At the same time, each dosing plate 42 passes under the assembly of pre-dosing hoppers 41, so that each hopper 411 doses the predefined quantity of product into the chambers 421 with which to fill the compartments of the capsules to be made.

Once all the chambers 421 of a dosing plate 42 have been previously filled with the product to be transferred, the dosing plate 42 is moved (positioning section II) until it reaches a forming plate 22 on which the first PVA film 61 has been placed and deformed.

Subsequently, each dosing plate 42 is arranged superimposed on a respective forming plate 22, so that each chamber 421 of the dosing plate 42 corresponds to a mold 224. This presupposes that the number and arrangement of the chambers 421 of each dosing plate 42 corresponds to the number and arrangement of the molds 224 of each forming plate 22. However, for the operation of the dosing apparatus 1 this condition is not strictly necessary. In fact, in some embodiments, for example, the number of molds 224 of a forming plate 22 may be different (e.g., smaller) from the number of chambers 421.

In this case, however, only some chambers 421 will fill the corresponding molds 224. At least one chamber 421 must be arranged at a mold 242. This overlapping occurs while the forming plate 22 is moving in the aforesaid advancement direction A. The dosing plate 42 therefore moves in a coordinated manner with the relevant forming plate 22, so that there is no relative motion between the two.

In this step, the release valves 422 of the dosing plate 42 are opened with an electric command and the product (e.g., detergent or the like) from the chambers 421 is transferred, passing through the respective delivery duct 423, to the mold 224 below, which, as mentioned, is already previously coated with said first PVA film 61, as can be schematically seen in FIG. 1 in the step or section III.

When the powder is deposited, since the relative motion between the dosing plate 42 and the forming plate 22 is zero, the dosing and stratification of the powder is uniform. The time interval so that the chambers 421 and the molds 224 are overlapped is sufficient to guarantee the complete transfer of the product contained in the chambers 421 of the dosing plates 42 to the respective molds 224.

Furthermore, in this operating step, the dosing plate 42 is superimposed and brought close to the upper surface 223 of the forming plate 22, possibly almost touching the first PVA film 61 arranged thereon. In this way, in the event that the product to be dosed is powder, leakage, i.e. contamination of the outer edges of the mold 224 and/or of the upper surface 223 of the forming plate 22, would be avoided.

Once the filling of the molds 224 has been completed, each forming plate 22 is always moved in the advancement direction A, leaving the dosing unit 4 to reach the second applicator assembly 5 and complete the production of the capsules C.

In particular, the second PVA film is wetted with water using the wetting roller 51 and pressed onto the forming plates 22 by the pressure roller 52, so as to couple it to the first PVA film 61, closing the coated molds 224 filled with product.

Finally, the extraction roller 53 allows the extraction of the capsules C made in the direction of the arrow B2 from the dosing apparatus 1.

The used forming plates 22 are then reused thanks to the conveyor belt 21. Alternatively, they can be returned to the inlet (i.e. at the heated roller 31) with any other transport system. As can be seen, the return speed of the forming plates 22 and the dosing plates 42 is independent of each other and of the feed rate A of the forming plates 22 themselves.

Furthermore, in some embodiments, the return speed according to the arrow A' of the forming plates 22 may be greater than the feed rate A. In this way, a smaller number of forming plates 22 overall may be used with a constant length of the conveyor belt 21.

In this way there is also the design freedom to separate the length of the transport belt 21 from the product length of the capsule C to be made.

Figure 3:
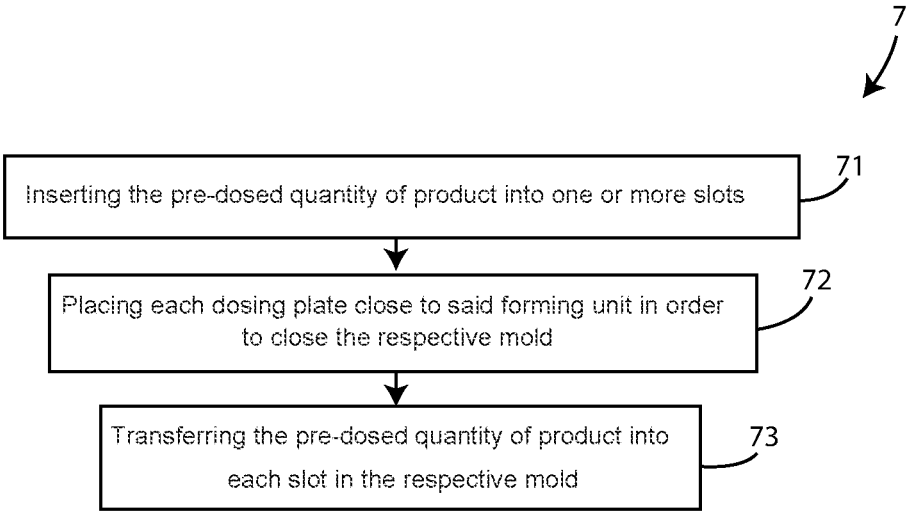
FIG. 3 shows a flow chart showing the dosing method of the dosing apparatus of FIG. 1.

A flowchart showing the main steps of the dosing method 7 performed by the dosing apparatus 1 is shown in FIG. 3, which comprises the following steps of:

- inserting 71 a pre-dosed quantity of product into said chambers 421 of each dosing plate 42
- placing 72 each dosing plate 42 next to a respective forming plate 22 of said forming unit 2, so that each chamber 421 is arranged at a respective mold 224, so as to close it; in this step, therefore, the dosing plate 42 is approached or is also in contact with the upper surface 223 of the base 221 of the forming plate 22; and
- transferring 73 the quantity of pre-dosed product in each chamber 421 into the respective mold 224; in this step, the release valve 422 located at each chamber 421 is opened to allow the passage of said pre-dosed quantity of product into the respective mold 224, so that it passes through the delivery duct 423, before reaching the coated mold 224; in this step, therefore, the mold 224 is substantially hermetically closed; furthermore, the relative motion of each dosing plate 42 with respect to the respective forming plate 22 is zero.

Figure 4:
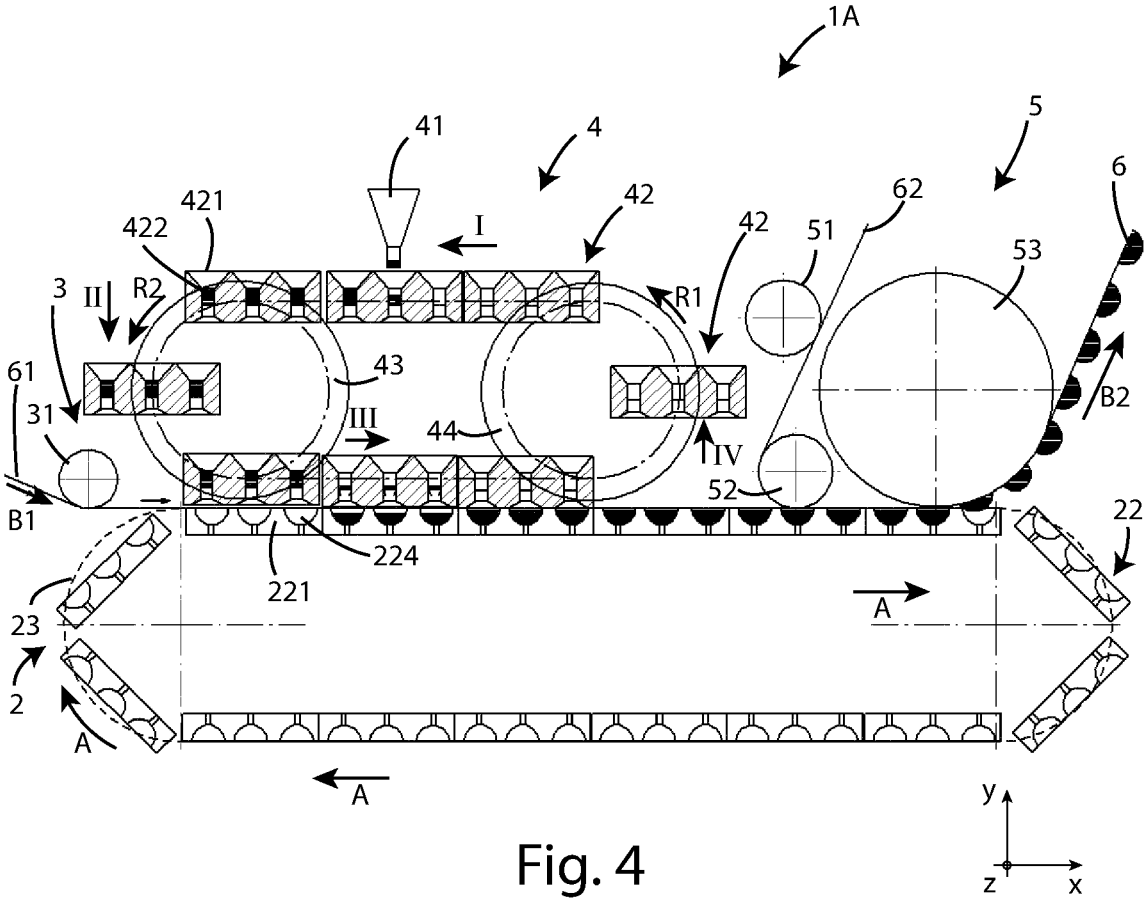
FIG. 4 shows a schematic side view of a second embodiment of a dosing apparatus according to the present invention.

Referring to FIG. 4, a second embodiment of the dosing apparatus 1A according to the present invention can be observed.

In particular, the dosing apparatus 1A is simplified in terms of design as the conveyor belt 21 is equipped with a pair of continuous and parallel tracks 23 (in the figure, being a side view, only one is indicated), to which the forming plates 22 are coupled, removably or not, which are therefore arranged in a fixed manner and at a predefined distance from each other.

Furthermore, the dosing unit 4 comprises a rotary system comprising a first circular carousel 43 arranged upstream, but immediately downstream of said heated roller 31, and a second circular carousel 44, arranged downstream of the first circular carousel 43. Between the first and second circular carousels 43, 44 there are upper and lower connection guides not shown in the figures, which allow the movement of the dosing plates 42 between the two carousels.

Furthermore, the assembly of pre-dosing hoppers 41 is arranged at the top, substantially interposed between said first and second circular carousels 43, 44.

Said first and second circular carousels 43, 44 perform the function of transporting the dosing plates 42. In particular, in the return section IV, a dosing plate 42 is lifted by the second carousel 44 after being decoupled from the pair of tracks 23, performing an anti-clockwise rotary motion (arrow R1), for a distance equal to an arc of a circle. Subsequently, in the passage from said second carousel 44 to said first carousel 43, there is the pre-dosing section I, wherein the dosing plate 42 passes under the assembly of pre-dosing hoppers 41, so that by the hoppers 411 the respective chambers 421 may be filled with the product to then be transferred to the molds 224.

In the positioning section II, each dosing plate 42 is always coupled in a removable manner and moved by said first carousel 43, always following an anti-clockwise rotation R2 for an arc of a circle, until it is coupled again with said pair of tracks 23. In this case, the chambers 421 of the dosing plate 42 are pre-filled with the product to be transferred, which will be transferred to the molds of the relative forming plate 22 (dosing section III).

Figure 5:
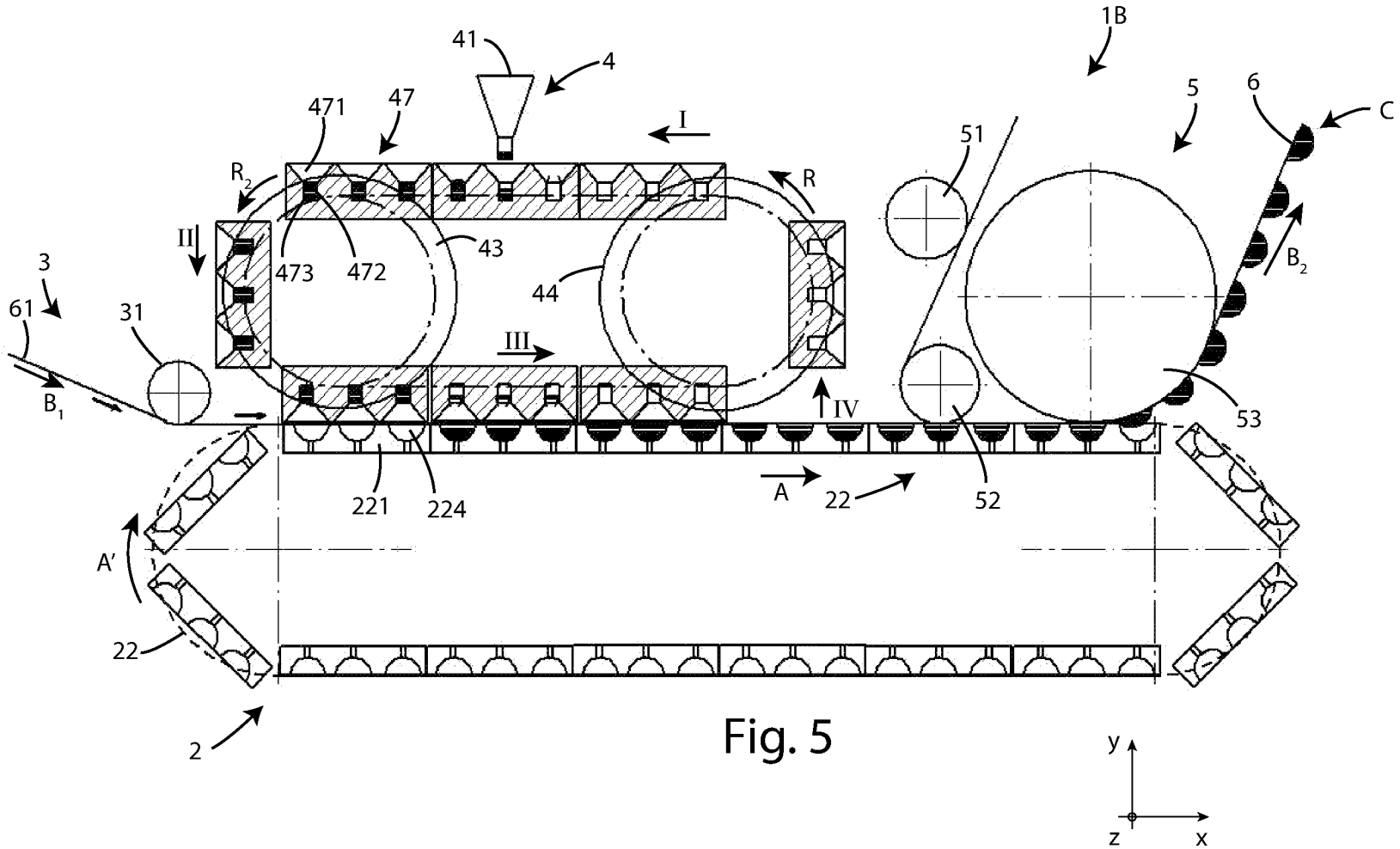
FIG. 5 shows a schematic side view of a third embodiment of a dosing apparatus according to the present invention.

FIG. 5 shows a third embodiment of the dosing apparatus 1B. In particular, as can be seen, the structure of the dosing apparatus 1B is substantially similar to that shown in FIG. 4. However, in the present embodiment, each of the dosing plates, indicated here with the numerical reference 47, comprises a plurality of chambers 471 at the top, each having a volume sufficient to accommodate the quantity of powdered product to be inserted into each compartment of the single-dose capsule to be made.

At each chamber 471 there is always a release valve 472, of the electromechanical operated type, which puts each chamber 471 into fluid-dynamic communication with a containment cavity 473.

Also in the present embodiment, the release valves 472 may be of different types, mechanical, pneumatic, magnetic or electromagnetic.

The first and second circular carousels 43, 44 also perform the function of transporting the dosing plates 47 in the present embodiment.

However, unlike the solution described in FIG. 4, in the return section IV, the dosing plate 47 is lifted by the second carousel 44 after being decoupled from the pair of tracks 23, always performing an anti-clockwise rotary motion (arrow R1), and overturned during the rotation of the second carousel 44, in the circular arc section.

Also in this case, in the passage from said second carousel 44 to said first carousel 43, there is the pre-dosing section I, wherein the dosing plate 47 passes under the assembly of pre-dosing hoppers 41, so that by the hoppers 411 the respective chambers 471 may be filled with the powdered product to then be transferred to the molds 224.

Subsequently, the release valve 472 opens to allow the product to move from the respective chamber 471 to the containment cavity 473. Following said transfer, the release valve 472 is closed, sealing the product in the containment cavity 473. In the positioning section II, each dosing plate 47 is always coupled in a removable manner and moved by said first carousel 43, always following an anti-clockwise rotation R2 for an arc of a circle, until it is coupled again with said pair of tracks 23.

In this section, unlike the dosing apparatus 1A, the dosing plates 47 are overturned. The product, however, remains contained in the containment cavities 473 thanks to the closure of the release valves 422, which prevent it from escaping.

When, again during step II, each of the dosing plates 47 is in this case overturned and placed on a respective forming plate 22, in step III each chamber 471 (as said, with the dosing plate 47 completely overturned with respect to its position in step I) is placed at a respective mold 224.

During the dosing step III, therefore, the release valve 472 is opened and the product contained in the containment cavity 473 is released.

This embodiment allows the production of technically simpler and therefore less expensive dosing plates 47.

Furthermore, the risks that the product may block the delivery duct 423, not filling the capsule compartment, are limited, limiting the risk that the product may get blocked, slowing down production and/or limiting the number of defective capsules.

Figure 6:
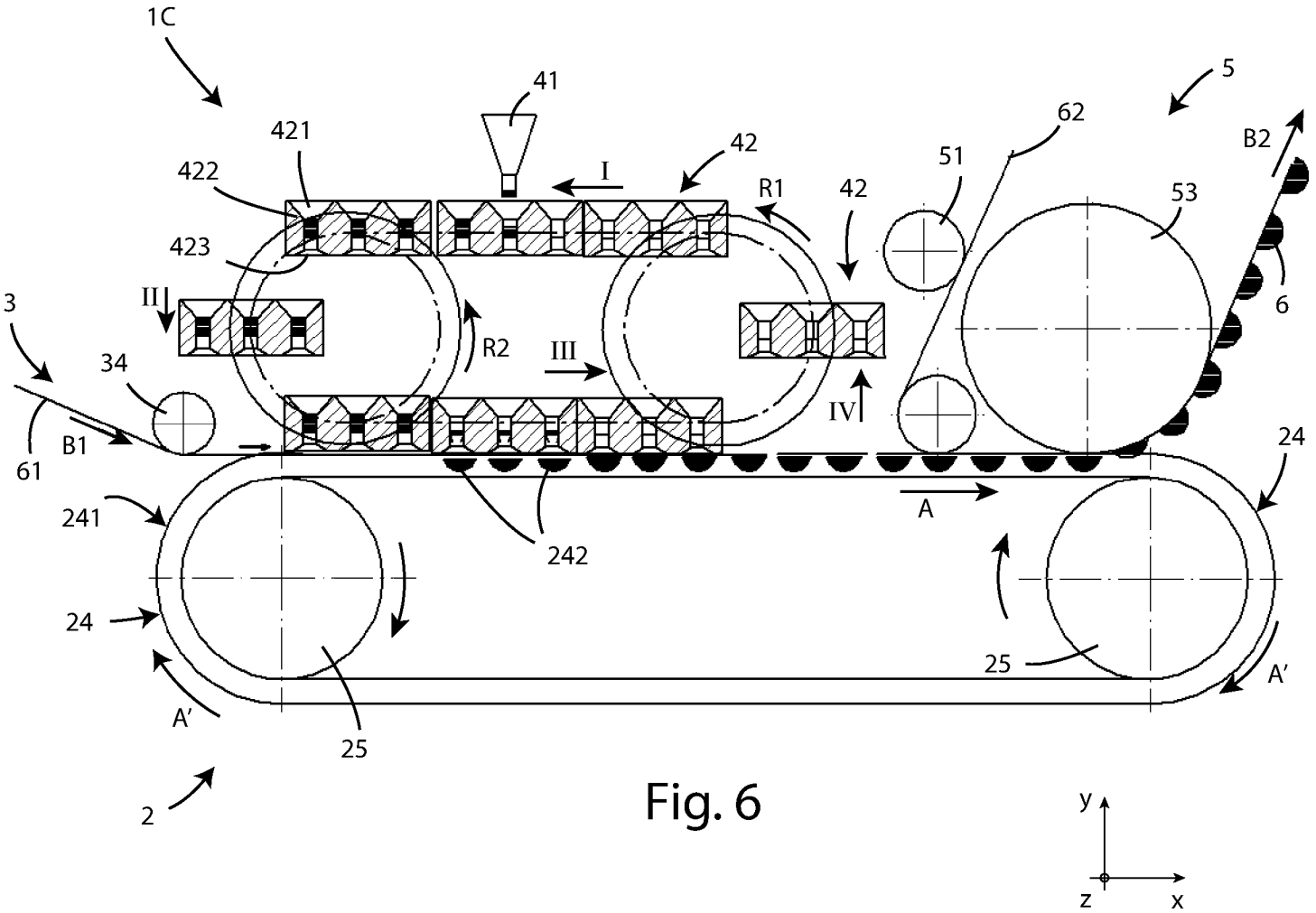
FIG. 6 shows a schematic side view of a fourth embodiment of a dosing apparatus according to the present invention.

Referring to FIG. 6, a fourth embodiment of the dosing apparatus 1C according to the present invention can be observed.

The dosing apparatus 1C differs from that according to the second embodiment illustrated in FIG. 4, in that the forming unit 2 comprises, instead of the conveyor belt 21 or the pair of tracks 23, a forming belt 24 continuously moved by two driving rollers 25. The molds 242 are formed on the upper outer surface 241 of said forming belt 24. Said molds 242 are associated with a vacuum system (not shown in the figure) similar to that described and depicted for the molds 224 of the forming plates 22 of the dosing systems 1 and 1A, respectively, according to the first and second embodiments.

Through the movement of said driving rollers 25, the molds 242 are moved in the advancement direction A when the compartments are filled.

The operation of the dosing apparatus 1C is, in principle, similar to that of the systems shown in FIGS. 1 and 4. However, in this case, when the dosing plates 42 have been pre-filled with the product to be inserted into the compartments of the capsules C, to be made by the assembly of pre-dosing hoppers 41, each of said dosing plates 42 in the dosing section III is arranged on the forming belt 24, so that each of the chambers 421 is positioned at a respective mold 242 obtained on the outer surface 241, on which the first PVA film 61 is previously arranged, suitably heated by the heated roller 31 and deformed by the vacuum system to make it adhere to the concave inner surface of the molds 242.

Also in this embodiment, the dosing plates 42 are arranged in proximity, and at most in contact, with the outer surface 241, so as to avoid dispersion, i.e. the risk that the powdered product may settle on the outer surface 241 of the forming belt 24, compromising the optimal coupling of the second PVA film 62 to the first PVA film 61 via wetting roller 51 and the pressure roller 52 of the second applicator assembly 5.

This embodiment makes the structure and arrangement of the chambers 421 of the dosing plates 42 and the molds 242 of the forming belt 24 more constrained.

Figure 7:
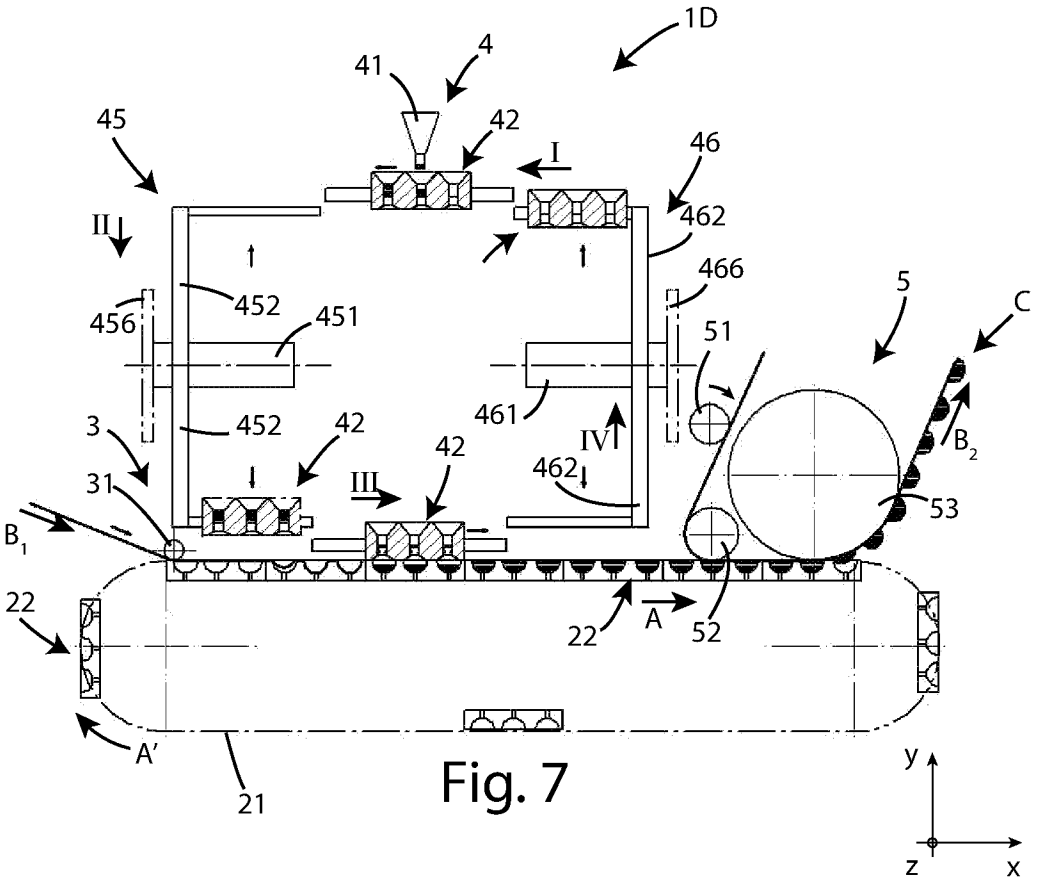
FIG. 7 shows a schematic side view of a fifth embodiment of a dosing apparatus according to the present invention.
Figure 8:
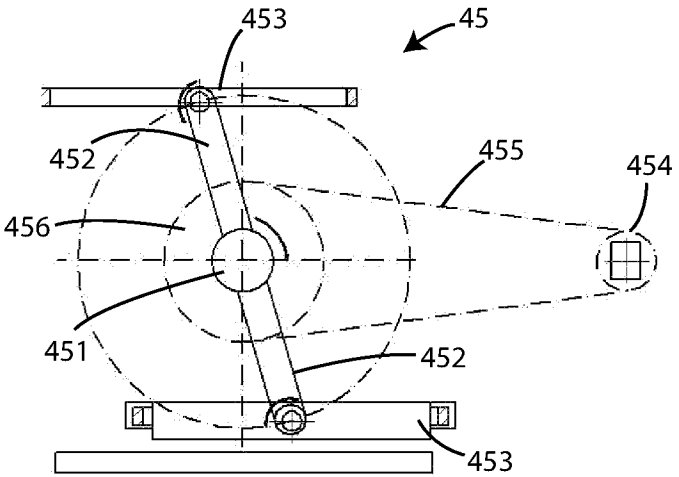
FIG. 8 shows a side view of a movement unit of the dosing apparatus according to FIG. 7.

Referring to FIGS. 7 and 8, a fifth embodiment of the dosing apparatus 1D according to the present invention can be observed.

The dosing apparatus 1D differs from that according to the first embodiment illustrated in FIG. 1, in that the dosing unit 4 includes a first movement unit 45, arranged upstream of said pre-dosing hoppers 41, and a second movement unit 46, arranged downstream of said pre-dosing hoppers 41.

The two movement units 45 and 46 are arranged facing each other and are completely similar structurally and functionally. Therefore, only one will be described below, it being understood that the same numbering logic of the parts will be applied in reference to the other movement unit not explicitly described.

The first movement unit 45 comprises a shaft 451, and a pair of arms 452, arranged opposite to said shaft 451. In particular, each arm 452 has an end fixed to said shaft 451.

Furthermore, each of said movement units 45 also comprises two gripping members 453, each arranged at the other end of a respective arm 452. The two arms 452 are configured to rotate around said shaft 451. The gripping members 453 are configured, however, for picking up and releasing a dosing plate 42.

The movement unit 45 also comprises an electric motor 454, a pulley 456, clamped onto said shaft 451, and a transmission belt 455, for transmitting the rotary motion from said electric motor 454 to said drive shaft 451.

In other embodiments, different drive systems for the drive shaft 451 may be envisaged.

The second movement unit 46 also comprises, similarly to the first movement unit, the shaft 461, the pair of arms 462, the two gripping members 463, the electric motor (not shown in the figure and which can also be the same as the first movement unit 45), a pulley 466 and the transmission belt (not shown in the figure). In particular, when one of the gripping members 463 of the second movement unit 46 is close to the forming unit 2, it takes the dosing plate 42 which has just filled the respective molds 242 during the dosing step III. This arm 462 rotates around the shaft 461 and after having completed a semi-circumference, releases the dosing plate 42 at the assembly of pre-dosing hoppers 41 for the pre-dosing of powder. In this way, step IV is performed.

After the chambers 421 of the dosing plate 42 have been suitably filled (step I), a gripping member 453 of the first movement unit 45 detects said dosing plate 42 and performs a half turn of the circumference, again moved by the electric motor and rotating around the respective shaft 451.

Subsequently, said gripping member 453 releases the dosing plate 42 onto the conveyor belt 21 of the forming unit 2, thus effectively completing step II.

The movement of the dosing plates 42 in steps I and II occurs by suitable means or guides, which allow their translation, e.g., by linear motors.

For the correct operation of the dosing apparatus 1D according to the fourth embodiment, the rotation speeds of the arms 452 and 462, of the first 45 and second 46 movement units respectively, must be coordinated with the movement speed of the dosing plates 42 of the conveyor belt 21, so as to allow correct carrying out of the pre-dosing and filling steps.

One or more apparatuses (1, 1A, 1B, 1C, 1D), as well as the dosing method (7) just described may be integrated into machines for producing single-dose capsules (C) wherein at least one compartment is filled with a pre-dosed quantity of powdered substances. These machines could also comprise apparatuses for dosing liquids and/or gels.

One advantage of the present invention is that it allows an increase in the production speed of the dosing apparatus 1 by freeing the dosing time of the product into the coated molds from the speed of the line and the geometry of the mold itself. In fact, the transfer of the powdered product carried out with tracking without relative speed, in addition to improving the distribution of the powder in the mold, thanks to the geometric correspondence between the chambers of the dosing plates and the mold, allows elimination of powder dispersions, which could contaminate the outer edges where the welding seal is made with the upper PVA film.

A further advantage of the present invention is that it allows the production of capsules regardless of the pitch or length of the entire apparatus.

The present invention has been described by way of illustration, but not by way of limitation, according to its preferred embodiments, but it is to be understood that variations and/or modifications may be made by experts in the art without thereby departing from the relevant scope of protection, as defined by the claims that follow.

The invention claimed is:

1. A dosing apparatus for dosing powdered substances for producing single-dose capsules, comprising at least one compartment in which at least one of said powdered substances is present, comprising:

a forming unit, having one or more molds movable in an advancement direction on a conveyor of a continuous moving type, and a dosing unit comprising at least one dosing plate provided with one or more chambers each configured to contain a pre-dosed quantity of at least one of said powdered substances, and to transfer said quantity to a respective mold to be filled of the one or more molds, the dosing unit having a dosing plate moving arrangement separate from the conveyor of the forming unit, wherein in operation said at least one dosing plate is pre-filled at the dosing unit with the pre-dosed quantity of at least one of said powdered substances to be transferred into the respective mold to be filled before the at least one dosing plate exits the dosing unit, then the at least one dosing plate pre-filled with the pre-dosed quantity is:

transferred from the dosing plate moving arrangement of the dosing unit to the forming unit, then is positioned on the respective mold to be filled and is configured to move at a same speed as the respective mold to be filled, so as not to present any relative motion between the at least one dosing plate and the respective mold to be filled for an entire time needed to fill the respective mold to be filled.

2. The dosing apparatus of claim 1, wherein said at least one dosing plate is configured to position itself so as to close said respective mold to be filled while said quantity of at least one of said pre-dosed powdered substances is transferred from said one or more chambers to the respective mold to be filled.

3. The dosing apparatus of claim 1, wherein said at least one dosing plate comprises at least one release valve for enabling delivery of said quantity of at least one of said pre-dosed powdered substances into said one or more chambers.

4. A machine for producing single-dose capsules comprising the at least one compartment in which at least one powdered substance of said powdered substances is present, comprising at least one dosing apparatus according to claim 1.

5. The machine of claim 4, comprising at least one liquid and/or gel dosing apparatus for dosing in at least one other compartment of said single-dose capsules, a quantity of liquid and/or gel.

6. The dosing apparatus of claim 1, wherein the at least one compartment in which at least one of said powdered substances is present comprises at least one stationary hopper being part of the dosing unit.

7. A dosing method, for dosing pre-dosed powdered substances for producing single-dose capsules, comprising at least one compartment in which at least one of said powdered substances is present, comprising:

inserting a quantity of at least one of said pre-dosed powdered substances into at least one chamber of a dosing plate at a dosing unit;

after inserting the quantity of at least one of said pre-dosed powdered substances into at least one chamber of the dosing plate at the dosing unit, transferring the dosing plate with the inserted quantity of the at least one of said pre-dosed powdered substances to a forming unit having one or more molds movable in an advancement direction on a conveyor of a continuous moving type, after transferring the dosing plate with the inserted quantity of the at least one of said pre-dosed powdered substances to the forming unit, positioning said dosing plate with the inserted quantity on a respective mold to be filled of the one or more molds, and moving the dosing plate at a same speed as the respective mold to be filled, so as not to present any relative motion between the dosing plate and the respective mold to be filled for an entire time needed to fill the respective mold to be filled, and transferring said quantity of at least one of said pre-dosed powdered substances from said at least one chamber of the dosing plate into the respective mold to be filled while the dosing plate and the respective mold to be filled are moving at the same speed.

8. The dosing method of claim 7, comprising:

approaching said dosing plate to a forming unit, so that at least one chamber is arranged at the respective mold to be filled.

9. The dosing method of claim 8, wherein said dosing plate and said respective mold to be filled does not have relative motion while said quantity of at least one of said pre-dosed powdered substances is being transferred from said at least one chamber to the respective mold to be filled.

10. The dosing method of claim 8, comprising:

moving said dosing plate so as to prepare the dosing plate for the step of approaching said at least one dosing plate to said forming unit; and moving said dosing plate so as to prepare it for the step of inserting a quantity of at least one of said pre-dosed powdered substances into said at least one chamber of said dosing plate.

11. The dosing method of claim 7, wherein said dosing plate moves along a closed path between the steps of:

inserting the quantity of at least one of said pre-dosed powdered substances into said at least one chamber of said dosing plate; and transferring said quantity of at least one of said pre-dosed powdered substances from said at least one chamber, into the respective mold to be filled.

12. The dosing method of claim 7, wherein transferring the dosing plate with the inserted quantity of the at least one of said pre-dosed powdered substances to a forming unit includes transferring the dosing plate with the inserted quantity of the at least one of said pre-dosed powdered substances from a dosing plate moving arrangement of the dosing unit to the forming unit, wherein the dosing plate moving arrangement is separate from the conveyor of the forming unit.

* * * * *